United States Patent [19]

Stahl

[11] Patent Number: 4,556,383

[45] Date of Patent: Dec. 3, 1985

[54] RESONANT BURNER AND STARTING MECHANISM THEREFOR

[76] Inventor: Karl-Heinz Stahl, Zum Felchen 20, D-7770 Überlingen/Nussdorf, Fed. Rep. of Germany

[21] Appl. No.: 552,297

[22] Filed: Nov. 16, 1983

Related U.S. Application Data

[63] Continuation-in-part of Ser. No. 190,045, Sep. 23, 1980, abandoned.

[30] Foreign Application Priority Data

Sep. 26, 1979 [DE] Fed. Rep. of Germany ..... 2938958

[51] Int. Cl.[4] ..... F23C 11/04

[52] U.S. Cl. ..... 431/1; 60/39.77

[58] Field of Search ..... 431/1, 2, 255; 60/39.76, 39.77, 247–249; 122/16, 24; 252/359 CG, 359 A

[56] References Cited

U.S. PATENT DOCUMENTS

| | | | |
|---|---|---|---|
| 2,634,804 | 4/1953 | Erickson | 431/1 |
| 3,855,148 | 12/1974 | Locher et al. | 60/39.77 X |

FOREIGN PATENT DOCUMENTS

| | | | |
|---|---|---|---|
| 1243918 | 6/1967 | Fed. Rep. of Germany . | |
| 1551756 | 3/1970 | Fed. Rep. of Germany | 431/1 |
| 774089 | 5/1957 | United Kingdom . | |

*Primary Examiner*—Randall L. Green

*Attorney, Agent, or Firm*—Toren, McGeady, Stanger, Goldberg & Kiel

[57] ABSTRACT

In the disclosed resonant burner a common battery energizes the ignition and an air jump. The latter drives fuel, delivered to a reservoir from a fuel tank, to a carburetor nozzle. The reservoir is a narrow tube, whose fluid can easily be driven by little pressure and with low volumes of air, but is sufficiently long to contain enough fuel to start the burner.

25 Claims, 4 Drawing Figures

RESONANT BURNER AND STARTING MECHANISM THEREFOR

This application is a continuation-in-part application of application Ser. No. 190,045, filed Sept. 23, 1980, now abandoned.

BACKGROUND OF THE INVENTION

This invention relates to resonant burners, also known as pulse burners, and particularly to fueling or starting mechanisms for such burners. The invention is more specifically directed to a mechanism in which an ignition switch, a battery, and an ignition voltage generator form part of the burner's ignition circuit.

Fueling or starting mechanisms for resonant burners generally use a battery composed of four 1.5 volt transistor battery cells and a mechanical ignition voltage generator which, while starting, draws approximately 1.5 amperes from the battery for about 10 to 20 seconds. Under these circumstances, the battery has a service life which is depleted in approximately two years.

An object of the invention is to improve resonant burners.

Another object of the invention is to improve the fueling or starting mechanisms for such burners.

Another object of the invention is to provide a starting mechanism which permits the battery that the powers the mechanism to last essentially as long as with previous mechanisms, while nevertheless allowing the battery to drive an air pump that assists the starting process.

SUMMARY OF THE INVENTION

According to a feature of the invention such objects are attained by making the ignition voltage generator an electronic ignition voltage generator and locating an electric motor in the circuit which drives a pump that feeds compressed air to a carburetor and a fuel supply.

According to another feature of the invention, the electronic ignition voltage generator is of a known available type which draws only about 0.4 amperes from the battery during the approximate 10 to 20 second starting period.

According to yet another feature of the invention the electric motor for driving the pump is a miniature electric motor which draws only about 1.2 to 1.4 amperes from the battery during the starting period.

According to still another feature of the invention, the pump drives air into the upper part of an upstanding line that, on the one hand, communicates with a fuel tank so that it contains fuel to a level equal to the fuel in the tank, and on the other hand, communicates from a point below the fuel level with a nozzle of a carburetor.

According to another feature of the invention, at the fuel level, the line has a cross-sectional area which is a minor fraction of the cross-sectional area of the fuel tank.

According to still another feature of the invention, the line has a cross-sectional area for fuel which is less than one-tenth of the cross-sectional area for a fuel in the tank.

According to yet another feature of the invention, the cross-sectizonzal area for fuel in the line is less than 1% of the cross-sectional area of the fuel in the tank.

According to yet another feature of the invention, the pump is in the form of a two-bellow diaphragm pump.

According to yet another feature of the invention, the electric motor and the pump are combined to a single unit.

According to still another feature of the invention, the single unit pump and motor are mounted on the resonant burner instead of the known manually activated air ball.

According to another feature of the invention, the battery is an alkaline battery.

According to yet another feature of the invention, the line forms a fuel reservoir line, and a check valve which opens in the direction of the top part of the line connects the reservoir line to the air pump, a second check valve which opens toward the nozzle connects the fuel in the reservoir line to the nozzle of the carburetor, a third valve connects the pump with the nozzle of the carburetor and opens toward the nozzle of the carburetor.

According to yet another feature of the invention, a fourth check valve which opens to the ambient air is connected between the check valve going to the reservoir line and the pump.

These and other features of the invention are pointed out in the claims. Other objects and advantages of the invention will become evident from the following detailed description when read in light of the accompanying drawings.

DETAILED DESCRIPTION OF THE PREFERRED EMBODIMENTS

Figure 1:
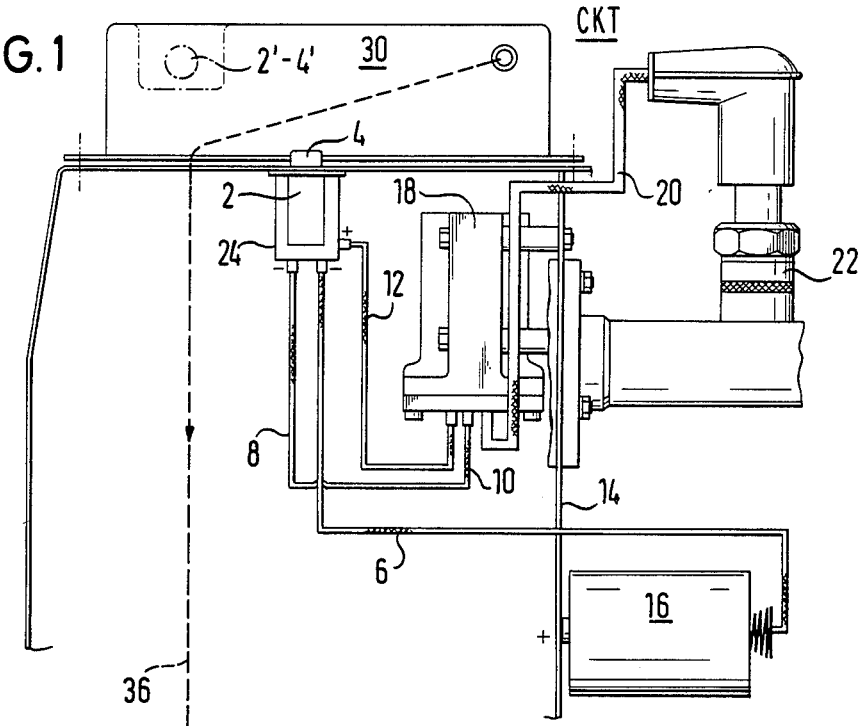
FIG. 1 is a partially schematic diagram of a mechanism embodying features of the present invention.
Figure 3:
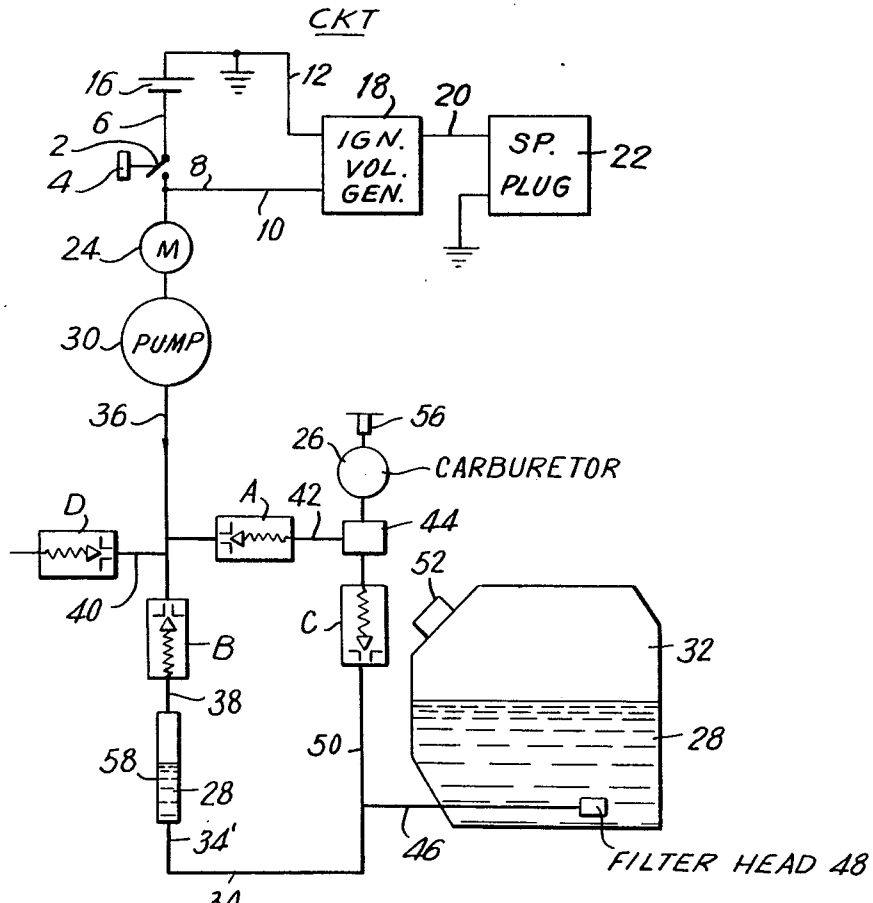
FIG. 3 is a schematic diagram illustrating the arrangement of FIG. 1 more schematically.
Figure 3:
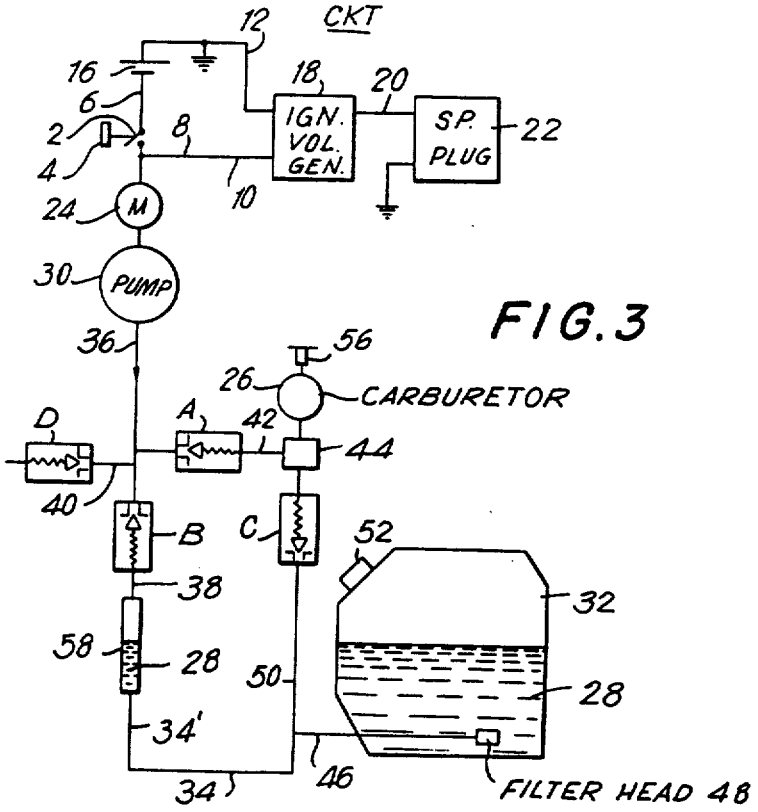
Figure 4:
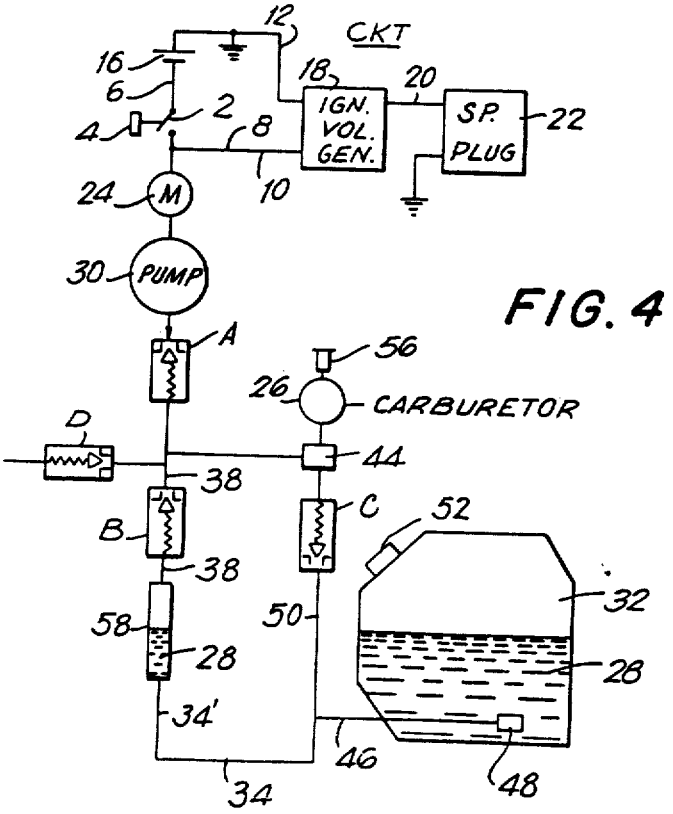

In FIGS. 1 and 3, an ignition switch 2, which when closed by means of a pushbutton 4, closes a circuit CKT composed in part of lines 6, 8, 10, 12 and 14. Also included in the circuit CKT are a battery 16 and an electronic ignition voltage generator 18. A high voltage line 20 connects the output of the ignition voltage generator 18 to a spark plug 22 of the resonant burner.

Figure 2:
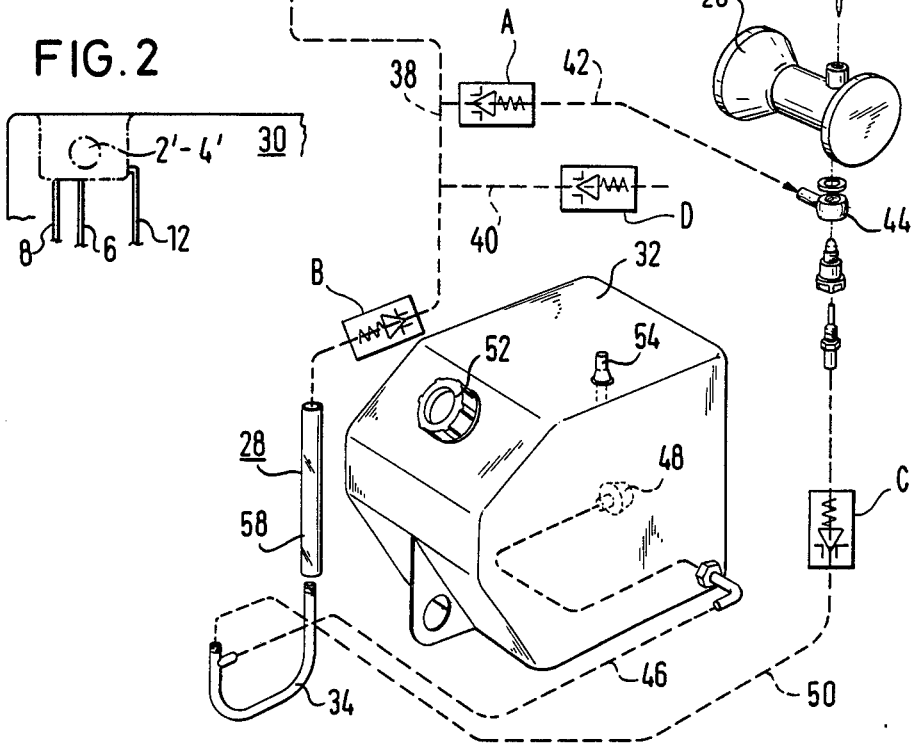
FIG. 2 is a drawing showing alternate positioning of the ignition switch in FIG. 1.

A miniature electric motor 24 in the circuit CKT, composed in part of lines 6, 8, 10, 12, and 14, drives a two-bellow diaphragm pump 30 which supplies compressed air to a carburetor 26 and a fuel supply 28. According to an embodiment of the invention the switch 2 with the pushbutton 4 is mounted on the burner housing. According to the emodiment of FIG. 2, the switch 2 and the pushbutton 4 are mounted on the housing of the pump 30 as shown schematically by the switch 2' and the pushbutton 4'.

The fuel or fuel supply 28 is stored in a fuel tank 32. A syphon line 34 is connected to the fuel 28 in the tank 32 via a connector line 46 and a filter head 48 inside the fuel tank 32. The syphon line 34 passes to or below the lowest level of the fuel 28 in the tank 32 and therefor in effect syphons the fuel out of the tank to a vertical transparent pipe 58 that communicates with the upstanding portion 34' of the syphon line 34. In the undisturbed condition, the fuel 28 fills the pipe 58 to the level of the fuel 28 in the tank 32. Because the pipe 58 is transparent, it is possible to view the level of the fuel 28 in the pipe 58. Preferably, the interior diameter of the pipe 58 is substantially uniform and has a horizontal cross-sectional area less than 1% of a horizontal cross-sectional area of the fuel in any portion of the tank 32. However, according to an embodiment of the invention, the cross-sectional area of the internal diameter of the pipe 58 may be up to 10% of the cross-sectional area of the fuel in the tank 32. The internal cross-sectional area of the line 34 transverse to its length is equal to or smaller than the pipe 58. The pipe 58 and line 34 together form a fuel reservoir.

A connection line 36 connects the pump to a line 38 which contains a check valve B which in turn readies the pipe 58 at the top of the syphon line 34. A relief valve D in a line 40 connects the line 36 to ambient air in response to excessive pressure. A branch line 42 with a check valve A connects the line 36 to a Laval nozzle 44 of the carburetor 26. Each of the valves A, B, and D are directional so as to permit flow of air from the pump 30 but not toward the pump 30.

The line 46 connects the syphon line 34 to the fuel tank 32 and terminates at a filter head 48 inside the fuel tank 32. A line 50 connects the syphon line 34 to the carburetor 26 via the Laval nozzle 44 through a check valve C which permits flow toward the nozzle but not away from the nozzle.

A screw cap 52 with a vent valve 54 closes an inlet nozzle on the fuel tank 32. A regulating screw 56 at the carburetor 26 adjusts the fuel-air mixture entering the resonant burner in the usual manner.

The valves A, B, C and D all open against the action of the springs therein.

The valve C permits fuel to flow to the nozzle 44 but closes in the pressure phases of the resonant burner in order to prevent the fuel from being pressed back in the line 50 and into the tank 32.

To start the resonant burner, the pushbutton 4, or 4' is pressed down by the thumb of the left hand and the right hand turns the regulating screw from its closed position so that a fuel-air mixture enters the resonant burner through the carburetor 26. If the mixture is ignitable, then the resonant burner starts and continues to run in the usual manner. The pushbutton 4 or 4' can then be released and the regulating screw can be opened until the resonant burner operates in the desired manner. The latter is audible from the low cracking noises coming from the resonant burner, such as during the production of aerosols.

The oscillation frequency of the resonant burner is approximately 100 Hz. In the suction phase of the resonant burner, the valve C is open to draw in fuel. Therefore, the valve C vibrates in synchronism with the resonant burner.

In the starting phase, air is pressed by the compressed air pump into the line 36 and the latter presses the fuel located in the pipe 58 and the syphon line 34 through the valve C into the nozzle 44. At the same time, air is fed to the nozzle 44 through the valve A via the line 42 to atomize the fuel. If the air pressure in the line 36 is too great during the starting phase, the valve D opens. This prevents air flow via the line 50 into the nozzle 44 during the starting process.

During normal operation in its negative pressure phases, the resonant burner draws duel via the line 50 and air via the line 42 through the valves C and A. The spring action of the valve B is adjusted such that it does not open during normal operation. The suction in the line 50 removes fuel from the tank 32 via the line 46. However, it does not draw in air from the line 38. In the suction phases, the air flow is mainly through the non-operating compressed air pump 30 via the line 36 and the valve A in the line 42 to the nozzle 44. The valve D is always closed during normal operation.

When the device is shut down, the fuel level in the tank 32 is visible in the transparent pipe 58 above the syphon line 34.

The fuel 28 in the reservoir, i.e., the syphon line 34 and the pipe 58, is sufficient to make it possible to start the resonant burner. That is, the total fuel in the pipe 58 and the syphon line 34 is sufficient when depressed by pressure from the pump 30 to raise enough of the fuel in the line 50 to the valve 44 to allow starting of the resonant burner. Therefore, the total interior volume of the syphon line 34 and pipe 58, as established by its length and interior diameter, should be sufficiently greater, at any fuel level in tank 32, than the total interior volume of the vertical portion of the line 50 from the line 46 to the valve 44 so as to result in raising of the fuel level to the valve 44 and continued application of the fuel to the valve 44 during the starting operation. This can be done by making the syphon line 34 sufficiently long or its bore sufficiently large to contain enough fuel. In effect, the line 34 and pipe 58 acts as a reservoir for fuel 28 outside the fuel tank 32.

The present invention utilizes not only a large fuel tank 32 but a much narrower fuel reservoir composed of the syphon 34 and pipe 58. The bottom of the tank 32 communicates with a much narrower syphon line through the line 46. Hence, the present invention uses two communicating liquid containers 32 and 34, one substantially narrower than the other. Preferably, the cross-section area of each of the line 34 and pipe 58, transverse to their respective lengths is less than 1% of the horizontal cross-section area of the fuel in the tank 32 at any point. However, it is possible to use a line and pipe which are only smaller than 10% in cross-sectional area than the horizontal cross-section area of the fuel in the tank 32. Instead of advancing the fuel to the nozzle 44 by applying air pressure to the top of the fuel tank 32, the invention applies the air pressure to the top of the fuel 28 in the much narrower line 34 as extended by the pipe 58. By applying the air pressure to the top of the pipe 58 or line 34 rather than the top of the tank, the total volume of air needed to start pumping the fuel through the line 50 to the nozzle 44 is far less than would be required if air pressure were applied to the top of the tank 32. This is so because there is so little vacant area to fill above the fuel in the line 34 and pipe 58 as compared to the vacant volume above the fuel in the tank 32. This is extremely important in a resonant burner because the air pressure need be applied only to start the system. Once the fuel reaches the carburetor 28 and the resonant burner starts to operate, no further air pressure is necessary to advance the fuel.

The air pressure is needed only to start the fuel and make it reach the nozzle 44. Hence, the small volume of air above the fuel in the line 34 and pipe allows a small motor 24 to operate from a small battery 16 without draining the battery. This increases the life of the battery and permits the pump to made from smaller components than heretofore.

The relief valves A, B, C, and D have proven to be very practical and important for the starting process. The syphon line 34 is also important. The compressed air from the pump 30 through the line 36 therefor is not delivered into the fuel tank 32. The use of the syphon line 34 and pipe 58 causes the compressed air coming from the pump to be used significantly more efficiently than in the large space above the fuel level in the tank 32.

If the starting procedure is not successful then the pushbutton 4 or 4' must be released until the line 34 is again filled. In order to be able to see this, the upper portion of the syphon line is transparent at the pipe 58.

The pipe 58 may be considered a part of the syphon line 34, and hence, may be considered as forming a single syphon line (a single reservoir). When the fuel level is very low, fuel does not rise to the level of the pipe 58. At that time only the portion 34 of the reservoir is used.

Preferably, the siphon line 34 and pipe 58 have inner cross-sections substantially corresponding to the inner cross-section of the fuel supply line 50. Deviations of ±30% are tolerable, but deviations of only ±15% are preferred. The reason for the dimensioning is that the fuel is to be accelerated when starting in the siphon line 34 and pipe 58 in order to flow through the nozzle 44 at a high velocity. The volume of the siphon line 34 and pipe 58 corresponds to the quantity of fuel necessary for the starting process.

The valve A allows only a predetermined limited quantity of air to pass the nozzle 44 when starting, namely, the air quantity necessary for starting. The cross-sectional opening of the valve A is dimensioned accordingly. The valve B is dimensioned accordingly with reference to the fuel to be fed out of the siphon line 34 and pipe 58. The valve C is dimensioned according to the same criterion. The valve D releases excess air into the surroundings. Such excess air can occur because the air quantity delivered and the air pressure produced are different according to the state of charge of the batteries. This also depends on the surrounding air pressure, particularly as determined by altitude of the device above sea level.

Figure 4:
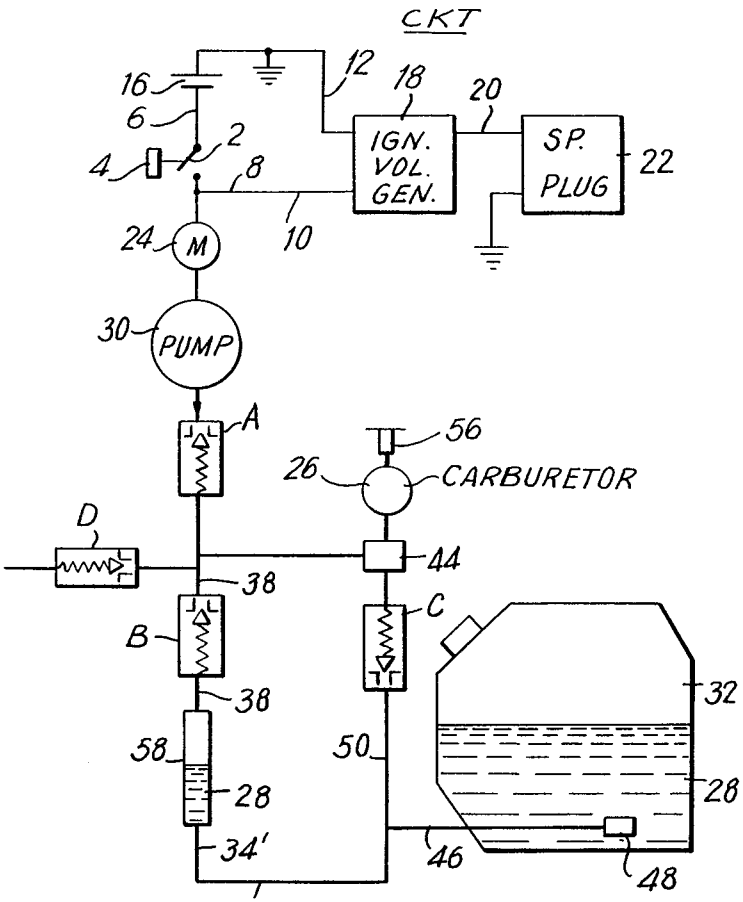
FIG. 4 is a schematic diagram illustrating another embodiment of the arrangement in FIGS. 1 and 3.

FIG. 4 differs from FIG. 3 in that the valve A is located in the line between the pump 30 and the junction of lines from nozzle 44, valve B, and valve D. Like the valve A in FIG. 3, it permits air flow from the pump 30 but not toward the pump.

While embodiments of the invention have been described in detail, it will be evident to those skilled in the art that the invention may be embodied otherwise without departing from its spirit and scope.

What is claimed is:

1. A mechanism for starting a resonant burner having an ignition voltage generator and a compressed air pump which are to be started by temporarily connecting a manually activating switch with a battery, characterized in a first line, a carburetor having a nozzle, a first one-way valve, a second line, a U-shaped reservoir line, a third line, a fourth line, a fuel tank, a second one-way valve, a third one-way valve, a transparent upper section in the reservoir line, the first line leading from the compressed air pump to the nozzle in the carburetor, the first line having therein the first one-way valve which opens in direction toward the nozzle, the second line branching from the first line and leading by means of the U-shaped reservoir line and the third line to a fuel tank, said reservoir line being connected with the fourth line to the nozzle of the carburetor, the second line before the reservoir line having the second one-way valve opening towards the reservoir line, the fourth line having therein the third one-way valve opening toward the reservoir line, and the reservoir line having a transparent upper section which communicates with the fuel tank by means of the third line and can fill with fuel to the level of the fuel in the fuel tank.

2. A mechanism according to claim 1, characterized in the first line upstream from the first one-way valve or the second line upstream from the second one-way valve having a branch-off line, and in a fourth one-way valve in said branch-off line and arranged to lead to the atmosphere.

3. A resonant burner as in claim 1, wherein said reservoir is a U-shaped line.

4. A resonant burner as in claim 3, wherein said U-shaped line has one vertical section connected to the pump and another vertical section connected to the tank at the bottom of the tank.

5. A resonant burner as in claim 4, wherein the internal cross-sectional area of the reservoir is less than 10% of the cross-sectional area of the tank.

6. A resonant burner as in claim 4, wherein the reservoir has a cross-sectional area less than 1% the cross-sectional area of the tank.

7. A resonant burner as in claim 1, wherein the volume of the interior of the reservoir is sufficient to receive enough fuel, when the amount of fuel in the tank is minimal, to permit starting the burner.

8. A resonant burner as in claim 7, wherein the internal cross-sectional area of the reservoir is less than 10% of the cross-sectional area of the tank.

9. A resonant burner as in claim 7, wherein said reservoir has continuous cross-sectional areas which are a minor fraction of the cross-sectional area of the tank and said areas extend throughout the expected levels of undisturbed fuel in the reservoir and above the level of undisturbed fuel in the reservoir, when the tank contains fuel.

10. A burner as in claim 9, wherein said reservoir communicates with said nozzle by means of a fuel line having an inner diameter, said reservoir being in the shape of a line having an inner diameter substantially equal to the inner diameter of the fuel line.

11. A burner as in claim 9, wherein said reservoir communicates with said nozzle by means of a fuel line having an inner diameter, said reservoir being in the shape of a line having an inner diameter substantially equal to the inner diameter of the fuel line within ±15%.

12. A burner as in claim 9, wherein said reservoir communicates with said nozzle by means of a fuel line having an inner diameter, said reservoir being in the shape of a line having an inner diameter substantially equal to the inner diameter of the fuel line within ±30%.

13. A resonant burner as in claim 1, wherein said reservoir line and said pump are connected through a one-way valve directed toward said reservoir, said reservoir is connected to said nozzle through a one-way valve directed toward said nozzle, and said line connecting said pump to said nozzle includes a one-way valve directed toward said nozzle.

14. A resonant burner as in claim 13, wherein a one-way valve directed toward ambient air is connected between said pump and said reservoir.

15. A resonant burner as in claim 14, wherein the one-way valve between said nozzle and said pump is arranged between the reservoir and the nozzle.

16. A resonant burner as in claim 14, wherein the one-way valve between the nozzle and said pump is arranged between the reservoir and said pump.

17. A resonant burner, comprising:
an ignition generator;
a spark plug connected to said generator;
connector means for receiving a battery and connected to said generator;
an air pump electrically connected to said connector means;
a carburetor having a mixing nozzle;
an air line connecting the pump to the nozzle;
a fuel tank having a horizontal cross-sectional area;
a fuel reservoir;
said fuel reservoir communicating with said fuel tank and being placed at a level for gravitationally drawing fuel from the tank to a level and communicating with said pump for receiving air pressure and communicating with said nozzle for delivering fuel to said nozzle when said reservoir receives pressure from said pump, and having an internal cross-sectional area which is a minor fraction of the cross-sectional area of the fuel tank.

18. A resonant burner as in claim 17, wherein the internal cross-sectional area of the reservoir is less than 10% of the cross-sectional area of the tank.

19. A resonant burner as in claim 17, wherein the reservoir has a cross-sectional area less than 1% the cross-sectional area of the tank.

20. A resonant burner as in claim 17, wherein said reservoir has continuous cross-sectional areas whose dimensions are a minor fraction of the cross-sectional area of the tank and said areas extend throughout the expected levels of undisturbed fuel in the receiver and above the level of undisturbed fuel in the reservoir, when the tank contains fuel.

21. A resonant burner as in claim 20, wherein the internal cross-sectional area of the reservoir is less than 10% of the cross-sectional area of the tank.

22. A resonant burner as in claim 20, wherein the reservoir has continuous cross-sectional areas which are a minor fraction of the cross-sectional area of the tank and said areas extend throughout the expected levels of undisturbed fuel in the reservoir, and above the level of undisturbed fuel in the reservoir, when the tank contains fuel.

23. A burner as in claim 17, wherein said reservoir communicates with said nozzle by means of a fuel line having an inner diameter, said reservoir being in the shape of a line having an inner diameter substantially equal to the inner diameter of the fuel line.

24. A burner as in claim 17, wherein said reservoir communicates with said nozzle by means of a fuel line having an inner diameter, said reservoir being in the shape of a line having an inner diameter substantially equal to the inner diameter of the fuel line within ±15%.

25. A burner as in claim 17, wherein said reservoir communicates with said nozzle by means of a fuel line having an inner diameter, said reservoir being in the shape of a line having an inner diameter substantially equal to the inner diameter of the fuel line within ±30%.

* * * * *

UNITED STATES PATENT AND TRADEMARK OFFICE

CERTIFICATE OF CORRECTION

PATENT NO. : 4,556,383

DATED : December 3, 1985

INVENTOR(S) : Karl-Heinz Stahl

It is certified that error appears in the above-identified patent and that said Letters Patent is hereby corrected as shown below:

The sheet of drawing containing figures 3 and 4 should be deleted to be replaced with figures 3 and 4 as shown on the attached sheet.

Signed and Sealed this

*Eighth* Day of *July 1986*

[SEAL]

*Attest:*

DONALD J. QUIGG

*Attesting Officer*

*Commissioner of Patents and Trademarks*